US005210722A

United States Patent [19]

Schwartz

[11] Patent Number: 5,210,722

[45] Date of Patent: May 11, 1993

[54] ANALOG TIMEPIECE MOVEMENT FOR LARGE DIAMETER ENERGY CELL

[75] Inventor: Herbert Schwartz, Wurmberg, Fed. Rep. of Germany

[73] Assignee: Timex Corporation, Middlebury, Conn.

[21] Appl. No.: 876,318

[22] Filed: Apr. 30, 1992

[51] Int. Cl.[5] ..... G04B 37/00; G04F 5/00

[52] U.S. Cl. ..... 368/88; 368/160; 368/220

[58] Field of Search ..... 368/88, 204, 276, 220, 368/228, 318, 160, 203

[56] References Cited

U.S. PATENT DOCUMENTS

| | | | |
|---|---|---|---|
| Re. 29,403 | 9/1977 | Yamazaki | 58/23 |
| 3,966,498 | 6/1976 | Wuthrich | 136/166 |
| 4,077,199 | 3/1978 | Sakuma et al. | 58/23 |
| 4,087,957 | 5/1978 | Miyasaka et al. | 368/88 |
| 4,144,705 | 3/1979 | Iinuma | 368/76 |
| 4,202,166 | 5/1980 | Komiyama et al. | 368/82 |
| 4,453,833 | 6/1984 | Saitoh | 368/88 |
| 4,496,246 | 1/1985 | Ota et al. | 368/88 |
| 4,744,066 | 5/1988 | Schwartz | 368/76 |
| 4,794,576 | 12/1988 | Schwartz et al. | 368/185 |

*Primary Examiner*—Vit W. Miska
*Attorney, Agent, or Firm*—William C. Crutcher

[57] ABSTRACT

Analog timepiece movement adapted for a large diameter, thin energy cell, the movement comprising a molded frame of insulating material having a top central wall, and having depending peripheral side wall portions. A flat bridge of insulating material divides the movement into an inner cavity. A stepping motor and gear train are disposed in the inner cavity and a quartz crystal is disposed outside of the cavity. One of the wheel assemblies is of non-magnetic material and extends through a hole in by the stepping motor stator. The peripheral wall portions and the bridge together define a circular envelope in the outer cavity adapted to locate and contain said energy cell. The movement is substantially elliptical in shape, the ellipse having a minor axis slightly greater than that of the energy cell, and the quartz crystal is disposed on one end of the elliptical frame alongside the energy cell.

5 Claims, 5 Drawing Sheets

ANALOG TIMEPIECE MOVEMENT FOR LARGE DIAMETER ENERGY CELL

BACKGROUND OF THE INVENTION

This invention relates generally to analog timepiece movements, especially for wristwatches, intended to use thin large diameter energy cells. More particularly, the invention relates to an improved analog timepiece movement with a stepping motor designed to use a long life lithium energy cell.

Prior art quartz analog timepieces are designed to accommodate a button energy cell of relatively small diameter inside the movement, the diameter of the cell being less than half the diameter of the movement. An example of such a movement is seen in Reissue Patent Number 29,403, reissued Sep. 20, 1977 to Yamazaki. Since the life of the energy cell is related to its physical size, a longer life button cell must either be made in a larger diameter, or it must be made thicker. Thick wristwatches are undesirable. Various ingenious arrangements have been suggested in order to accommodate larger energy cells without increasing the size of the watch movement. In one such case, as illustrated in my U.S. Pat. No. 4,744,066 issued May 10, 1988 and assigned to the present assignee, a relatively large diameter energy cell was accommodated by arranging an intermediate wheel assembly so that its axis extended through the circumferential air gap between the stepping motor rotor and the stator.

Another arrangement is shown in U.S. Pat. No. 4,077,199 issued to Sakuma, et al on Mar. 7, 1978, in which the battery diameter extends beyond the center line of the timepiece, i.e., beyond the axis of rotation of the timepiece hands. Other efforts to increase the battery size include proposals of unusual energy cell configurations in shapes other than circular, as exemplified in U.S. Pat. No. 3,966,498 issued Jun. 9, 1976 to P. Wuthrich and assigned to the present assignee.

While suggestions have been offered in the prior art for "layering" or stacking up a large diameter energy cell with an integrated circuit, frame and electro-optic display in a sandwich construction, these layer constructions have been proposed for timepieces having no moving parts. It would be desirable to enjoy the advantages offered by thin large diameter lithium energy cells available today in a long life quartz analog watch.

In quartz analog watches, it may also be desirable to provide movements for new sizes of energy cells. This may involve redesign of the movement using a new arrangement of the stepping motor, gears, setting mechanism, and other internal parts. It would be desirable to increase the size of the energy cell for a particular movement without redesign of the movement.

Accordingly one object of the present invention is to provide an improved analog timepiece movement adapted to be operated by a large diameter energy cell.

Another object of the invention is to provide an improved quartz analog timepiece movement adapted to operate with a large diameter thin lithium energy cell.

Still another object of the invention is to provide an improved quartz analog timepiece movement adapted for various capacity energy cells without substantial redesign of the movement.

DRAWINGS

The invention will best be understood by reference to the following description, taken in connection with the accompanying drawings, in which:

FIG. 1 is a developed elevational view in cross section of a quartz analog timepiece movement without the case, lens or watch hands, the view being developed along the line I—I of FIG. 4, FIG. 2 is a plan view from the back or movement side along lines II—II of FIG. 1, FIG. 3 is a view in the same direction taken along lines III—III of FIG. 1, FIG. 4 is a view in the same direction taken along lines IV—IV of FIG. 1, and FIG. 5 is a plan view in the same direction from the bottom or movement side of the timepiece movement.

SUMMARY OF THE INVENTION

Briefly stated, the invention comprises an improved analog timepiece movement adapted for powering by a large diameter thin energy cell, the movement comprising a molded frame of insulating material having a top central wall, and having depending peripheral side wall portions, defining together with said top central wall a movement-side cavity, a substantially flat bridge member of insulating material extending between said peripheral side wall portions so as to divide said movement-side cavity into an inner cavity and an outer cavity, the frame and bridge defining together a plurality of pairs of coaxial bores, each bore of a said pair defined in the frame and bridge respectively so as to provide bearings, a stepping motor having a rotor and stator disposed in said inner cavity, a quartz crystal disposed outside of said inner cavity, a dial-side gear train rotatably mounted on said top central wall on the side thereof opposite said inner cavity, a movement-side gear train rotatably mounted disposed in said inner cavity and having a plurality of reduction gear assemblies coupled to one another and to said rotor, at least one of said wheel assemblies coupling said movement-side gear train to said dial-side gear train, and at least one of said wheel assemblies being of non-magnetic material and extending through a hole defined by the stepping motor stator, said peripheral wall portions and said bridge member together defining a circular envelope in said outer cavity adapted to locate and contain said energy cell. In a preferred embodiment of the invention, the movement is substantially elliptical in shape, the ellipse having a minor axis slightly greater than that of the energy cell, and the quartz crystal being disposed on one end of the elliptical frame outside the inner cavity and alongside the energy cell, whereby energy cell and quartz crystal substantially fill the outer cavity 6.

DESCRIPTION OF THE PREFERRED EMBODIMENT

Figure 1:
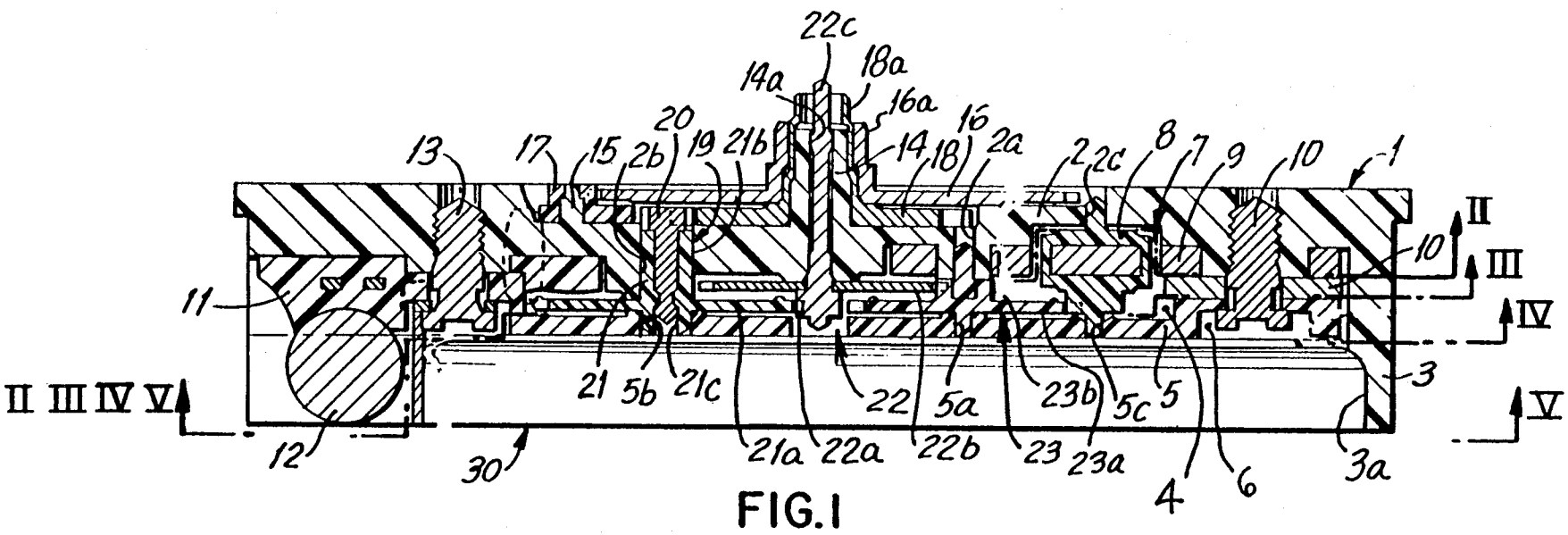

Referring now to FIG. 1 of the drawing, an electronic quartz analog timepiece movement is illustrated in cross-section as comprising a frame member 1 of insulating plastic material comprising a top central wall 2 with peripheral, depending side wall portions 3 together defining a movement-side cavity. A substantially flat bridge member 5 extends across the movement-side cavity between the peripheral side wall portions to divide the movement-side cavity into an inner cavity 4 and an outer cavity 6. A stepping motor shown generally at 7 is disposed in inner cavity 4 and includes a rotor 8 rotatably disposed with respect to a stator 9 and also having a stator bridge 10. The stepping motor is held in place, along with one side of the bridge 5 by a screw 10a.

An electrical driving circuit for the movement comprises an integrated circuit embedded in a lead frame 11, which also is arranged to carry a quartz crystal 12. Lead frame 11, together with the other end of bridge 5 is held in place by means of a screw 13. A printed circuit board may be substituted for a lead frame, the choice not being material to the present invention. The quartz crystal 12 and lead frame 11 are disposed outside of the inner cavity 4 and alongside the energy cell 30 in outer cavity 6. Together, the quartz crystal 12 and energy cell 30 substantially fill the outer cavity 6.

A dial-side gear train, so called because it is assembled from the dial-side of the top central wall 2, is rotatably journaled on a central stub 14 and a stub 15. The dial-side gear train comprises an hour wheel 16 having a hub 16a adapted to carry an hour hand (not shown). The hour wheel meshes with a minute wheel reduction assembly 17 and the latter is adapted to mesh with a center wheel 18. Center wheel 18 has a hub 18a adapted to carry a minute hand (not shown).

Center wheel 18 is driven by a third wheel assembly shown generally as 19 comprising a metal gear pinion 20 disposed with friction drive, snap fit in a plastic wheel member 21. Member 21 includes a toothed wheel 21a and oppositely extending journals 21b, 21c which are rotatably journaled in a coaxial pair of bores 2b, 5b in frame 2 and bridge 5 respectively. The third assembly is one element of a movement-side gear train (to be described), and extends through the top central wall of the frame to couple the dial-side gear train to said movement-side gear train.

The central stub 14 carrying the dial-side gear train defines a central bore 14a, which rotatably journals a seconds wheel assembly shown generally at 22. Seconds wheel assembly 22 includes a pinion 22a meshing with the toothed wheel 21a of the third wheel assembly. The seconds wheel assembly also includes a toothed seconds wheel 22b and a spindle 22c rotatably journaled in central bore 14a and adapted to carry a seconds hand (not shown).

A non-magnetic intermediate wheel assembly shown generally as 23 couples the stepping motor rotor 8 to the seconds wheel assembly 22. The intermediate wheel assembly comprises a plastic toothed wheel 23a engaging the stepping motor rotor pinion and a plastic pinion 23b engaging the seconds wheel 22b. Intermediate wheel assembly 23 passes directly through the stepping motor stator as will be described.

The foregoing described elements comprising third wheel assembly 19, seconds wheel assembly 22, and intermediate wheel assembly 23 comprise the movement-side gear train located in inner cavity 4 and coupled to one another and to the stepping motor rotor. The movement-side gear train drives the dial-side gear train from the pinion 20 of the third wheel assembly. The movement-side gear train is totally disposed within the inner cavity 4 between the top central wall 2 and bridge 5.

The depending peripheral wall portions 3 are contoured to fit the sides of an energy cell 30 as indicated at 3a, so that the peripheral wall portions, together with the bridge member 5 define a circular envelope in the outer cavity 6 adapted to fit and contain the energy cell 30. The projected area of the circular envelope overlaps and is larger than the projected areas occupied by the movement-side gear train and the dial-side gear train.

FIGS. 2, 3, 4 and 5 of the drawings are taken along section lines II—II, III—III, IV—IV, and V—V. Viewed in succession, these illustrate the present invention by showing the order in which parts are assembled into the movement.

Figure 2:
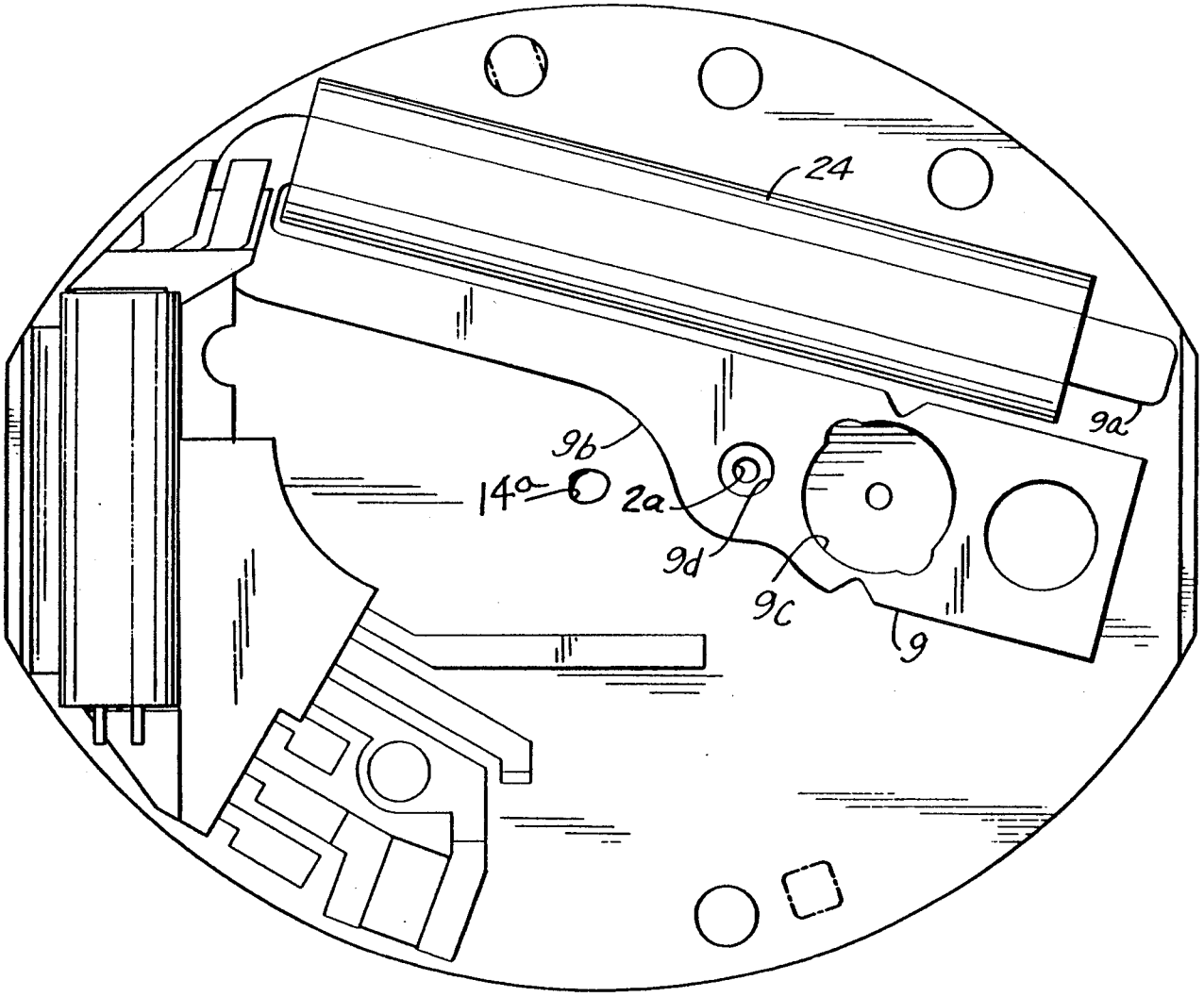

Referring to FIG. 2 of the drawing, stepping motor rotor stator 9 includes a u-shaped member having a core piece 9a and a flat stator portion 9b extending into the central part of the movement. A stator hole 9c accommodates the stepping motor rotor (not shown). It is particularly important to notice a hole 9d passing through the stator and serving to locate the stator on a peg which is integral with the frame and which defines a central bore 2a. Bore 2a serves to rotatably journal the non-magnetic intermediate wheel assembly 23 (See FIG. 1). A stepping motor coil 24 is placed over the core 9a and electrically connected to leads from lead frame 11.

Figure 3:
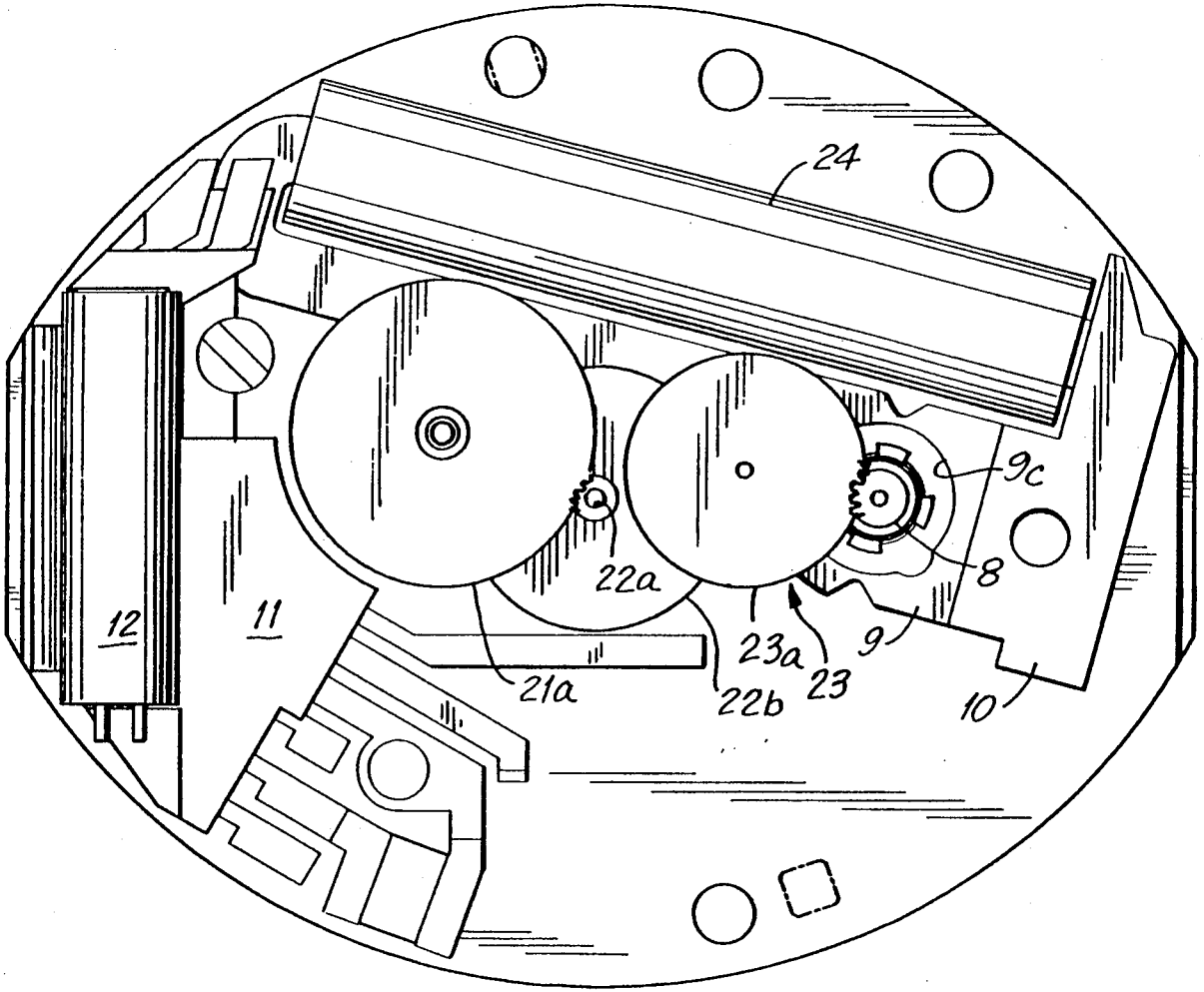

The next layer is illustrated in FIG. 3, wherein the stator magnetic flux path has been completed by adding a bridge 10. The teeth are omitted from the coupled gear members to clarify and simplify the drawing. The stepping motor rotor 8 engages and drives the toothed wheel 23a of the intermediate wheel assembly 23. Wheel assembly 23 through its pinion drives the seconds wheel 22b with the seconds hand, while the seconds wheel pinion 22a drives the toothed wheel 21a of the third wheel assembly. The axis of the intermediate wheel assembly 23 passes through the hole 9d in the stator 9.

Figure 4:
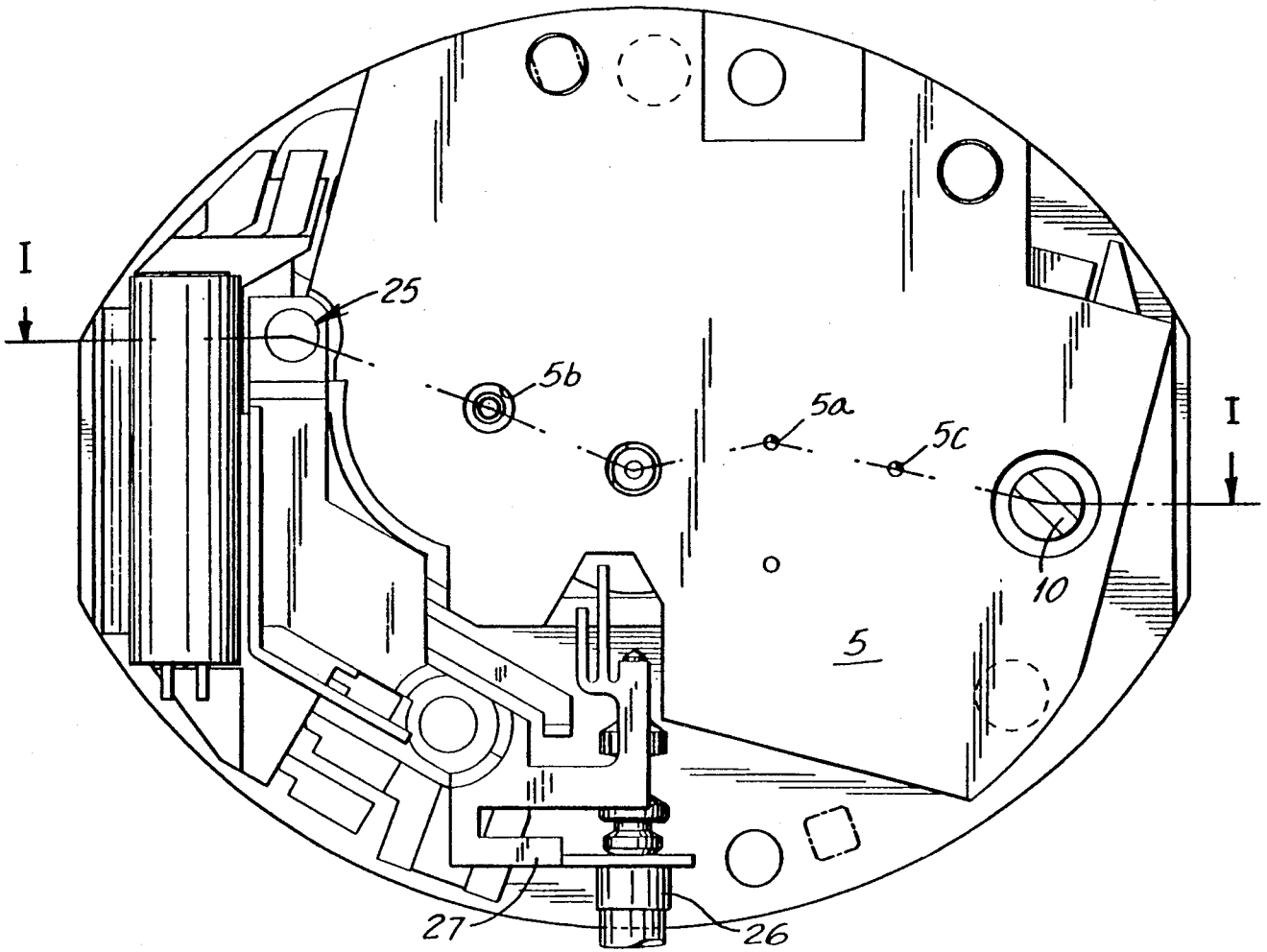

Reference to FIG. 4 illustrates the addition of bridge 5 which is held in place by a screw 10a and by screw 13 (not shown). The latter screw 13 also holds the lead frame assembly at the location indicated by reference 25. Other elements added to this subassembly include the setting stem 26 and detented braking member 27. Details of the latter assemblies may be seen by reference to my U.S. Pat. No. 5,083,300 issued Jan. 21, 1992 and U.S. Pat. No. 4,794,576 issued Dec. 27, 1988, both assigned to the present assignee and incorporated herein by reference.

The insulating bridge member 5 incorporates a plurality of bores for rotatably mounting members of the movement-side gear train, such as a bore 5a which is coaxial with and cooperates with bore 2a in the frame to provide a pair of bores rotatably journaling the intermediate wheel assembly 23. A similar bore 5b rotatably journals the lower end of the third wheel assembly 21, while a corresponding bore 2b in the frame cooperates therewith. A bore 5c journals the stepping motor rotor lower end, while a corresponding bore 2c in the frame journals the upper end.

Figure 5:
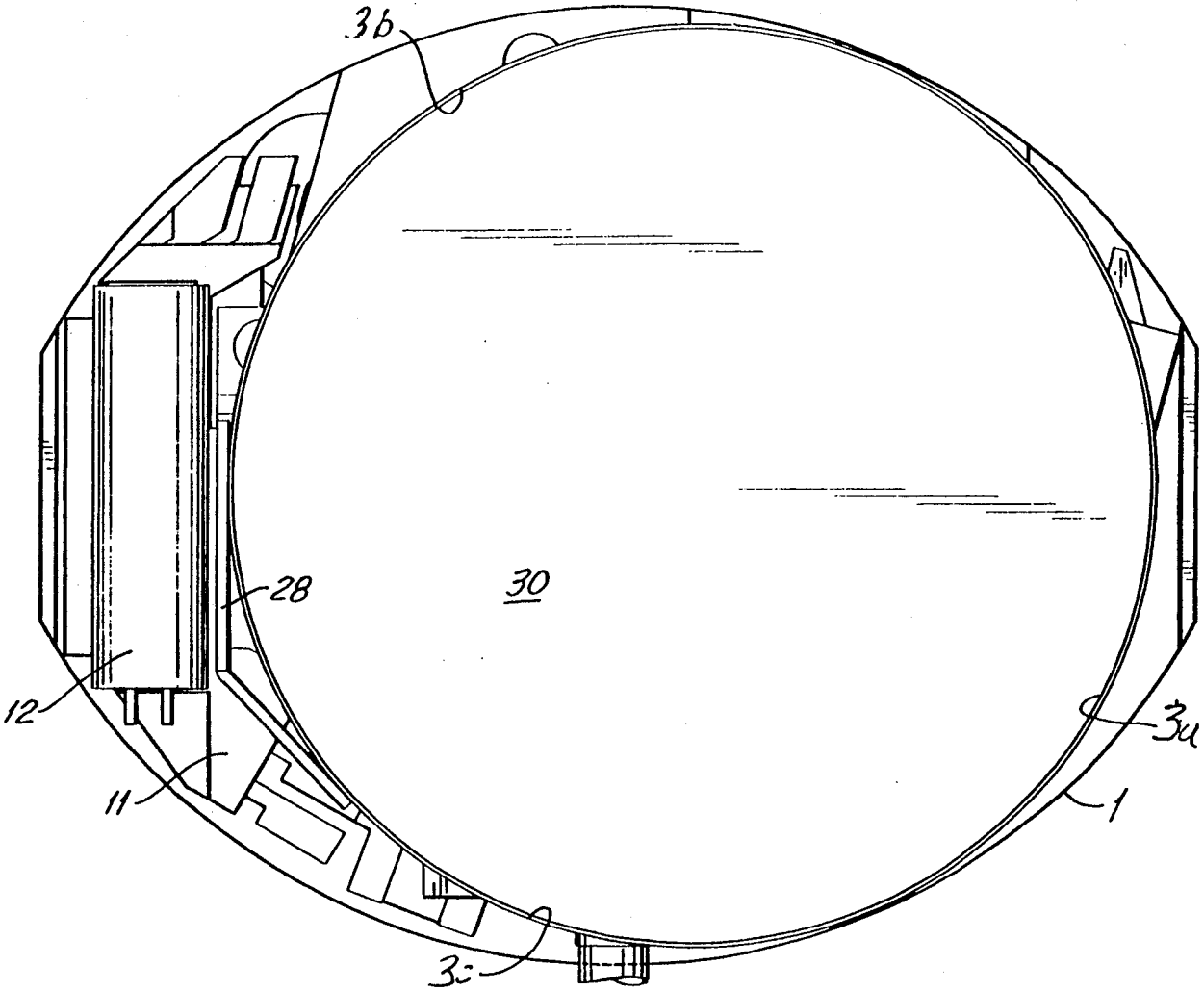

Referring now to FIG. 5 of the drawing, it is seen that in the preferred form of the invention illustrating the outline of frame 1 is roughly elliptical, although with flattened ends. The minor axis of the ellipse is slightly greater than the diameter of an energy cell 30. One peripheral side wall member is seen at 3a, another at 3b and another at 3c, parts of these being contoured and arranged as a circular envelope to locate the outer diameter of the large diameter energy cell 30 toward one end of the elliptical outline of frame 1 in the outer cavity 6 of the frame. This allows the electronic elements comprising lead frame 11 and quartz crystal 12 to be located at the other end thereof to one side of but also inside the outer cavity 6 which contains the energy cell 30. A conductive spring element comprising spring loaded contact member 28 is connected to the circuit elements and lead frame 11 and makes contact with one side of the energy cell 30.

By referring back to the side elevation, cross-section of FIG. 1, it can be seen that increasing the cell size can be accomplished by merely making the cell somewhat thicker and lengthening the peripheral side walls 3*a*, 3*b*, 3*c*. This alteration of frame thickness is the only change required to increase energy cell capacity of the movement and thereby increase the life of the timepiece between energy cell replacements.

Thus, there has been described an improved timepiece movement for an analog watch adapted to operate with a large diameter thin energy cell which is held in an outer cavity occupying substantially the entire movement side of the timepiece in an efficient manner. Since energy cell diameters are standardized, and more capacity can be supplied by making a thicker cell, it is not necessary to alter the movement when designing it for a longer life, other than to simply extend the peripheral walls of the frame and use a slightly thicker cell to obtain a longer life timepiece.

While there has been described herein what it is considered to be the preferred embodiment of the invention, other modifications will occur to those skilled in the art, and it is desired to secure in the appended claims all such modifications as fall within the true spirit and scope of the invention.

I claim:

1. An analog timepiece movement adapted for powering by a large diameter thin energy cell, said movement comprising:

a molded frame of insulating material having a top central wall, having depending peripheral side wall portions together defining a movement-side cavity, a substantially flat bridge member of insulating material extending between said peripheral side walls, so as to divide said movement-side cavity into an inner cavity and an outer cavity, said frame and bridge member together defining a plurality of pairs of coaxial bores, each bore of a pair defined in frame and bridge member respectively to provide bearings, a stepping motor having a rotor and a stator disposed in said inner cavity, said rotor having a pinion of insulating material rotatably journaled in said bearings, a dial-side gear train rotatably mounted on said top central wall on the side thereof opposite said inner cavity, a movement-side gear train disposed in said inner cavity and having a plurality of gear reduction wheel assemblies coupled to one another and to said stepping motor rotor, at least one of said wheel assemblies coupling the movement side gear train to the dial-side gear train, and at least two of said wheel assemblies having journals of insulating and non-magnetic material, rotatably journaled in said bearings, said peripheral wall portions and said bridge member together defining a circular envelope in said outer cavity adapted to fit and contain said energy cell, said energy cell being supported by said bridge member.

2. The combination according to claim 1 wherein the projected area of said circular envelope overlaps the projected areas of both dial-side and movement-side gear trains.

3. The combination according to claim 1, wherein said frame is substantially elliptical, said ellipse having a minor axis slightly greater than the diameter of said energy cell, and including a quartz crystal also disposed in said outer cavity.

4. The combination according to claim 3, wherein said circular envelope in said outer cavity is located toward one end of said elliptical frame, and further including means for mounting said quartz crystal at the other end of said elliptical frame, said quartz crystal and said energy cell substantially filling said outer cavity.

5. The combination according to claim 1, wherein said stator includes a flat portion which overlaps the axis of at least one of said non-magnetic wheel assemblies, said stator defining a hole therein to accommodate a journal of said non-magnetic wheel assembly passing therethrough.

* * * * *